US010273783B2

(12) United States Patent
Haugland et al.

(10) Patent No.: US 10,273,783 B2
(45) Date of Patent: Apr. 30, 2019

(54) TOOL FOR INTERNAL CLEANING OF A TUBING OR CASING

(71) Applicant: Qinterra Technologies AS, Stavanger (NO)

(72) Inventors: Lasse Haugland, Bryne (NO); Gunn Elin Toge, Stavanger (NO)

(73) Assignee: Qinterra Technologies AS, Stavanger (NO)

( * ) Notice: Subject to any disclaimer, the term of this patent is extended or adjusted under 35 U.S.C. 154(b) by 227 days.

(21) Appl. No.: 15/123,154

(22) PCT Filed: Feb. 18, 2015

(86) PCT No.: PCT/NO2015/050035
§ 371 (c)(1),
(2) Date: Sep. 1, 2016

(87) PCT Pub. No.: WO2015/137819
PCT Pub. Date: Sep. 17, 2015

(65) Prior Publication Data

US 2017/0067318 A1 Mar. 9, 2017

(30) Foreign Application Priority Data

Mar. 11, 2014 (NO) ..... 20140313

(51) Int. Cl.
*E21B 37/00* (2006.01)
*B08B 9/04* (2006.01)
*E21B 37/02* (2006.01)

(52) U.S. Cl.
CPC ..... *E21B 37/02* (2013.01)

(58) Field of Classification Search
CPC ..... E21B 37/00; B08B 9/027; B08B 9/04; B08B 9/043; B08B 9/045; B08B 9/047; B08B 9/36; F28G 3/04
(Continued)

(56) References Cited

U.S. PATENT DOCUMENTS 2,379,962 A * 7/1945 Hoerle ..... F41A 29/02 15/104.165
2,930,059 A * 3/1960 Frank ..... B08B 9/045 15/104.18
(Continued)

FOREIGN PATENT DOCUMENTS

EP 0298663 A2 1/1989
EP 2305948 A1 4/2011
(Continued)

*Primary Examiner* — Kenneth L Thompson
(74) *Attorney, Agent, or Firm* — Gable Gotwals

(57) ABSTRACT

The invention relates to a downhole tool (10) for use in a casing or tubing (99) in a well comprising a support (15) and a brush (12). The downhole tool (10) further comprises a lever arm (13) having a first end (13-1) and a second end (13-2) opposite the first end (13-1). The lever arm (13) is pivotably mounted to the support (15) and the brush (12) is mounted at the second end (13-2) of the lever arm (13). A driver means is provided for driving the lever arm (13) outwardly to press the brush against a wall of the casing or tubing (99) in operational use of the downhole tool (10). An advantage of the invention is that one size of the downhole tool may fit all sizes of a casing or tubing. The invention also relates to method of cleaning and honing casings or tubings in a well.

16 Claims, 4 Drawing Sheets

(58) Field of Classification Search
USPC ..... 15/104.05, 104.066, 104.09, 104.2
See application file for complete search history.

(56) References Cited

U.S. PATENT DOCUMENTS

| | | | | |
|---|---|---|---|---|
| 3,107,379 | A | 10/1963 | Hill | |
| 5,076,365 | A | 12/1991 | Hailey | |
| 8,376,043 | B2 | 2/2013 | Knobloch et al. | |
| 8,439,131 | B2 * | 5/2013 | Runia | E21B 10/62 175/257 |
| 8,499,399 | B1 * | 8/2013 | Jones | B08B 9/0436 15/104.19 |
| 9,470,065 | B2 * | 10/2016 | Kruger | E21B 37/02 |
| 9,752,403 | B1 * | 9/2017 | Frey | E21B 29/005 |
| 9,815,096 | B2 * | 11/2017 | Osaland | B08B 9/045 |
| 2012/0198637 | A1 | 8/2012 | Coyle | |

FOREIGN PATENT DOCUMENTS

| | | | | |
|---|---|---|---|---|
| GB | 1501971 | A | 2/1978 | |
| WO | 9806927 | A1 | 2/1998 | |
| WO | 0057100 | A1 | 9/2000 | |
| WO | 0166907 | A1 | 9/2001 | |
| WO | 2009108068 | A1 | 9/2009 | |
| WO | WO-2012060712 | A1 * | 5/2012 | B08B 9/0436 |

* cited by examiner

TOOL FOR INTERNAL CLEANING OF A TUBING OR CASING

CROSS-REFERENCE TO RELATED APPLICATIONS

This United States application is the National Phase of PCT Application No. PCT/NO2015/050035 filed 18 Feb. 2015 which claims priority to Norwegian Patent Application No. 20140313 filed 11 Mar. 2014, each being incorporated herein by reference.

The invention relates to a downhole tool for use in a casing or tubing in a well comprising a support and a brush. The invention further relates to a downhole tool assembly, a wireline tractor, and a drill string comprising such downhole tool. The invention also relates to a method of cleaning or honing a casing or tubing.

In the petroleum industry, various kinds of downhole tools are used for operations in a well. One of the operations to be carried out downhole is to clean seal bores (tubing or casing) and nipple profiles with a so-called downhole brush or scraping tool. Such tools may be coupled to a downhole tractor, or they may be operated via a wireline while residing in the well. Alternatively, they may be coupled to a drill string. In the prior art several kind of brush tools have been reported.

US2012/0198637A1 discloses a downhole brush tool including a tool body having a brush-supporting portion on the tool body between upper and lower stops. A split sleeve has a plurality of throughports therein, and a plurality of brush elements including a base member and a plurality of bristles extending from the base member. The base member is positioned within a cavity in the brush-supporting portion of the tool body, and a stop surface supported on the split sleeve engages a base member to prevent the brush element from passing radially outward. The disadvantage of this downhole brush tool is that it has a limited tolerance to diameter variations of the tubing or casing, because it relies on flexibility of the bristles.

U.S. Pat. No. 8,376,043B2 discloses an improved and enhanced spring loaded downhole tool for cleaning well casing bores. The tool comprises a mandrel, at least a first insert having a passageway therethrough, and at least a second insert, wherein both the first insert and the second insert are selected from at least one of a spring loaded scraper insert and a least one wire-brush insert. Further, the first insert and the second insert are slidingly received within a slot on a first mounting portion on the mandrel and a slot on a second mounting portion on the mandrel, from the outermost respective ends. The first insert is secured by a first retaining sleeve and the second insert is secured by a second retaining sleeve. Also disclosed is a unique method for cleaning a section of a casing with a downhole tool. The disadvantage of this downhole brush tool is that it has a limited tolerance to diameter variations of the tubing or casing, because it relies on design of the tool. The spring loading feature is only used to compensate for wear of the brushes.

WO2009/108068A1 discloses a well tool for cleaning the inside of casings and valves, particularly for removing mineral deposits. The tool comprises a main body comprising a drive-member, a power supply, a hydraulic pump and a gripping mechanism. The well tool is distinguished in that the tool further comprises a brush-head comprising radially expanding brush-members, wherein the tool by means of the drive-member is adapted to clamp the main body to the inside of a casing by means of the gripping mechanism, rotate the brush-head and expand the brush-members to a desired outer diameter. Contrary to the earlier discussed prior art solutions this document discloses a tool that offers tolerance to diameter variations of the tubing or casing. Nevertheless, this tolerance is limited.

The invention has for its object to remedy or to reduce at least one of the drawbacks of the prior art, or at least provide a useful alternative to prior art.

The object is achieved through features, which are specified in the description below and in the claims that follow.

In a first aspect the invention relates more particularly to a downhole tool for use in a casing or tubing in a well comprising a support and a brush, wherein the downhole tool further comprises:

- a lever arm having a first end and a second end opposite the first end, wherein the lever arm is pivotably mounted to the support, wherein the brush is mounted at the second end of the lever arm, and
- a driver means for driving the lever arm outwardly to press the brush against a wall of the casing or tubing in operational use of the downhole tool.

The effect of the downhole tool of the invention is that the reach of the brush is no longer determined by the dimensions of the brush itself, but rather by the dimensions of the pivotably lever arm. When the arm carrying the brush is now rotated around the tubing or casing a very large tolerance of diameter of the tubing or casing can be obtained by simply choosing a certain length of the lever arm. Expressed differently, one size of the downhole tool may fit all sizes of the casing or tubing. It must be stressed at this point that the invention is not limited to downhole tools for cleaning. The invention is also applicable in downhole tools for honing of the tubing or casing. The main difference between said tools mainly resides in the choice for the type of brush in terms of coarseness, shape of the tips of the brush, etc.

In an embodiment of the downhole tool of the invention the tool is configured for rotating the lever arm around the casing or tubing in operational use. That is advantageous for the brushing or honing process that is carried out by the downhole tool.

In an embodiment of the downhole tool of the invention the lever arm is configured for being rotated with respect to the support for allowing said rotation of the lever arm in operational use. This embodiment constitutes a first convenient way of achieving the rotation of the lever arm around the casing or tubing in operational use.

In an embodiment of the downhole tool of the invention the support is configured for being rotated for allowing said rotation of the lever arm in operational use. This embodiment constitutes a second convenient way of achieving the rotation of the lever arm around the casing or tubing in operational use.

In an embodiment of the downhole tool of the invention the driver means comprises a wing formed by or coupled to the lever arm for acting on well fluids in the well for creating an outwardly-directed force on the lever arm when being rotated in operational use of the downhole tool. The advantage of this embodiment is that the well fluids are used to create an outward pressure on the lever arm, thus pressing the brush against the wall of the casing or tubing for effective brushing or honing. Either a separate wing is mounted on the lever arm or the lever arm is shaped to have a wing shape by itself. In this embodiment, it is important that the shape and orientation of the wing is such that the rotational movement through the well fluids results in an outward force.

In an embodiment of the downhole tool of the invention the brush is mounted to the respective sub-arm such that the virtual axial axis of the brush makes an angle with the respective sub-arms to compensate at least partially for an angle between the sub-arms and the virtual axial axis of the downhole tool when the lever arm is driven outwardly in operational use of the downhole tool. This embodiment is advantageous when the downhole tool is run on over a bottom floor/wall of a tubing or casing, wherein the diameter of the tubing or casing is significantly larger than the diameter of the downhole tool (having typically the diameter of a wireline tractor). The parallel shift of the brush means that, when the lever arm assembly moves outward, the virtual axial axis of the brush remains parallel to the virtual axial axis of the downhole tool. A consequence of that is that a better contact is obtained between the brush and the floor/wall of a tubing or casing.

In an embodiment of the downhole tool of the invention the sub arm forms part of a lever arm assembly that further comprises a further sub-arm that is pivotably coupled to mechanical support, wherein the lever arm assembly further comprises an end portion to which said sub-arms are pivotably connected, wherein the brush is mounted on the end portion. This configuration constitutes an advantageous implementation of a downhole having at least partial angle compensation for the brush.

In an embodiment of the downhole tool of the invention the lever arm assembly is configured for parallel displacement of the brush when the lever arm is driven outwardly in operational use of the downhole tool. This embodiment effectively provides full angle compensation of the brush, when the lever arm assembly is moved outward.

In an embodiment of the downhole tool of the invention the driver means comprises an actuator for controlling the angular position of the lever arm for pushing the lever arm outwardly when being rotated in operational use of the downhole tool. This embodiment may be combined with the previous mentioned embodiment (in which case the actuator force adds to the force effected by the well fluids), but may also be used by itself.

In an embodiment of the downhole tool of the invention the brush comprises a cleaning brush and/or a honing brush. It has been mentioned before, but is repeated here that the invention may be advantageously applied in both brushing tools as well as honing tools. Combination of these two tools are also possible by implementing both a cleaning brush and a honing brush on the lever arm, or by providing said different brushes on different lever arms on the same tool.

In an embodiment of the downhole tool of the invention the lever arm is pivotably mounted to the support with the first end. In this embodiment the full length of the lever arm is advantageously used to create the maximum outward movement of the brush.

In a second aspect the invention relates more particularly to a downhole tool assembly comprising a wireline tractor and a downhole tool. In this embodiment the downhole tool of the invention is provided as an add-on tool to a wireline tractor. This embodiment constitutes a first main application area of the invention.

In a third aspect the invention relates more particularly to a wireline tractor comprising the downhole tool. Thus, contrary to the previously mentioned embodiment in this embodiment the downhole tool of the invention has been integrated into a wireline tractor. This embodiment constitutes a second main application area of the invention.

In a fourth aspect the invention relates more particularly to a method of cleaning or honing a casing or tubing in a well. The method comprising steps of:

providing a downhole tool with a brush provided on a lever arm in the casing or tubing;

rotating the lever arm around the casing or tubing, and;

driving said brush on the lever arm outwardly and pressing said brush against a wall of the casing or tubing while being rotated. The advantages and effects of the method of the invention follow that of the earlier discussed downhole tool in accordance with the invention.

In an embodiment of the method of the invention, in the step of providing the downhole tool, the downhole tool comprises a cleaning brush and/or a honing brush. In case the downhole tool comprises a cleaning brush, the method effectively constitutes a method of cleaning a casing or tubing, while in case the downhole tool comprises a honing brush, the method effectively constitutes a method of honing a casing or tubing. Combination of these two methods are also possible.

In the following is described an example of a preferred embodiment illustrated in the accompanying drawings, wherein.

Figure 1:
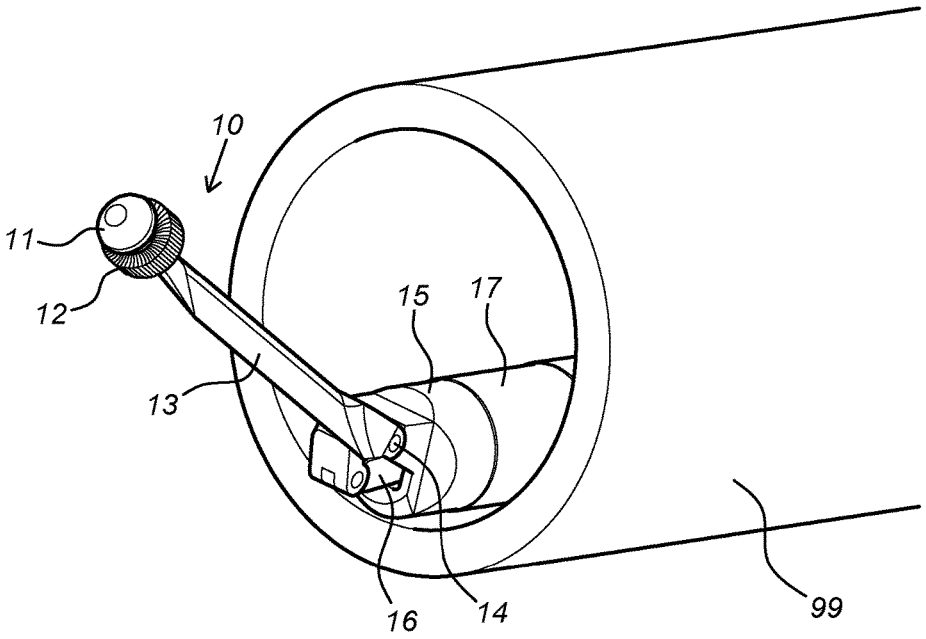
FIG. 1 shows an embodiment of the downhole tool of the invention while in a casing.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or an preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage. Throughout the Figures, similar or corresponding features are indicated by same reference numerals or labels.

Figure 2:
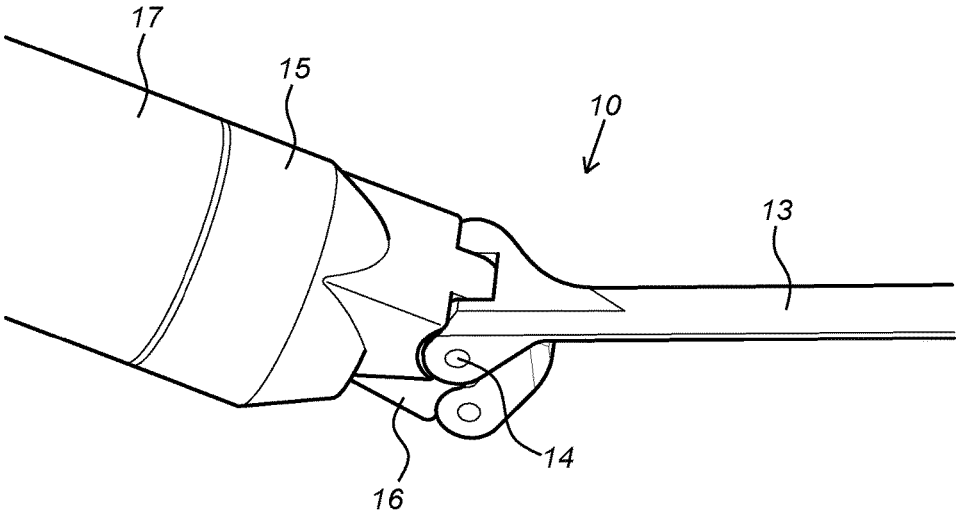
FIG. 2 shows a view in a larger scale of the embodiment of FIG. 1.

FIG. 1 shows an embodiment of the downhole tool 10 of the invention while in a casing 99. FIG. 2 shows a view in a larger scale of the embodiment of FIG. 1. Although this is not essential to the invention, the downhole tool 10 of this embodiment is capable of running over a bottom floor/wall of a tubing or casing 99 and still perform the cleaning or honing process, such being a clear advantage of the completely new concept of the invention. Obviously, in alternative embodiments the downhole tool 10 is provided with centralizing elements. The downhole tool of FIG. 1 comprises a mechanical support 15 to which a lever arm 13 is pivotably mounted via a pivot point 14. At the far end of the lever arm there is provided a brush 12 that is terminated with a bull nose 11. In this embodiment, the bull nose 12 effectively functions as a termination on a threaded end of the lever arm 13 that is inserted into the brush 12. To allow for a proper brushing effect it is strongly preferred that the brush 12 is fixedly mounted to the lever arm 13 such that it cannot rotated relative to the lever arm 13. The bull nose 12 preferably performs that function, but such function may also be achieved in other manners as will be understood by the person skilled in the art. Such effect may also be achieved by using a non-round termination on the lever arm 13 and a matching hole in the brush 12, for example. The downhole tool 10 further comprises an actuator arm 16 that is coupled to the lever arm 13. The actuator arm 16 runs through the mechanical support 15 and is actuated by an actuator 17 that is coupled to the mechanical support 15. The actuator 17 may generate the force to be applied by itself or it may be configured to transmit forces generated by a different tool (not shown) that is coupled to the downhole tool 10.

The embodiment of FIGS. 1 and 2 operates as follows. The downhole tool 10 runs over the floor/wall of the casing or tubing 99. While running the tool 10 is rotated around its axial direction. During this rotation, the lever arm 13 is pressed outwardly such that the brush 12 follows the contour of the casing or tubing 99. In the embodiment of FIGS. 1 and 2, this outwardly directed force is obtained in two ways. First, the lever arm 13 has been provided with the shape of a wing. The wing-shape is provided such that during rotation the well fluids in the casing apply said outwardly directed force to the wing 13. Second, the actuator 17 presses the lever arm/wing 13 outward during rotation via the actuator arm 16. It is important to note that in other embodiments one of said two options to create the outward force may be dispensed with. In addition, there is a third force that acts on the lever arm 13 (and brush 12), which is the centrifugal force.

Figure 3:
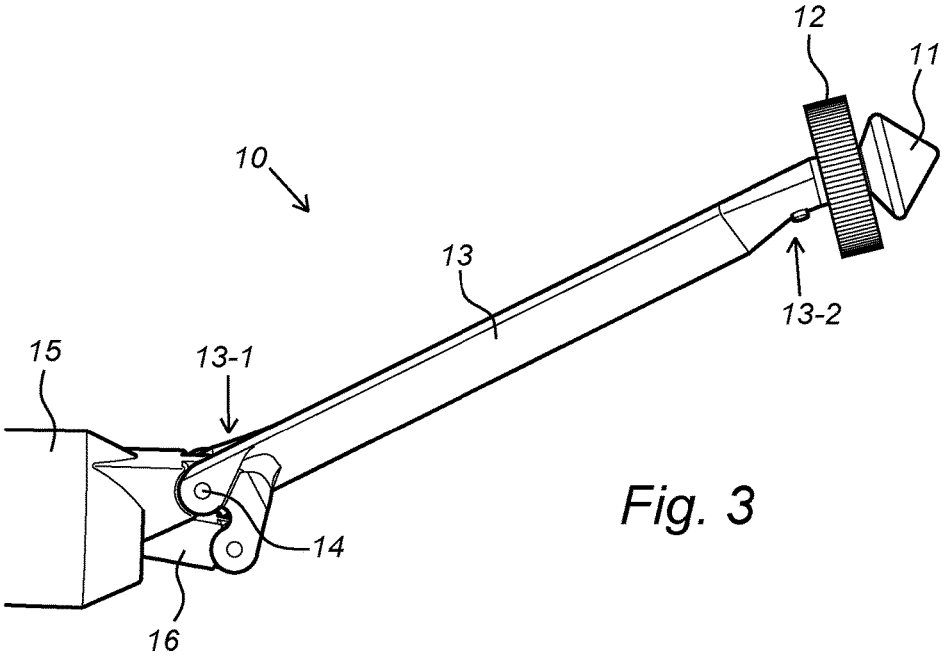
FIG. 3 shows a further view in a larger scale of the embodiment of FIG. 1.

FIG. 3 shows a further view in a larger scale of the embodiment of FIG. 1. FIG. 3 illustrates what is meant with first end and second end of the lever arm. The first end 13-1 is defined at the end of the lever arm 13 pivotably connected to the mechanical support 15 and the second end 13-2 is defined as the opposing far end of the lever arm 13, i.e. the end where the brush 12 and the bull nose 11 are provided.

Figure 4:
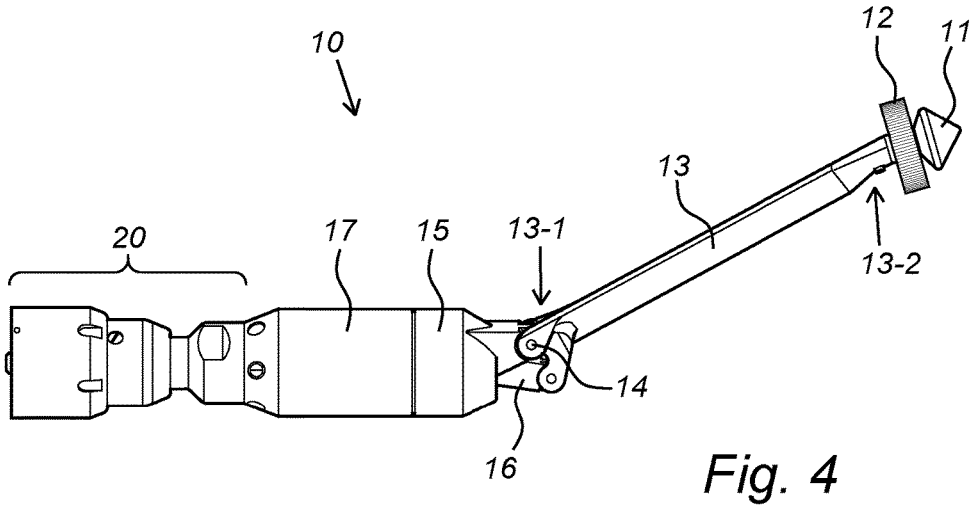
FIG. 4 shows a further embodiment of the downhole tool of the invention while coupled to a further downhole tool.

FIG. 4 shows a further embodiment of the downhole tool of the invention while coupled to a further downhole tool. This figure is included to illustrate yet a further aspect of the invention. The downhole tool 10 in this figure is coupled to a further downhole tool 20, for instance a rotor-or-push unit tool that in embodiments of the invention may be used to create said outward directed force to the lever arm 13.

Figure 5:
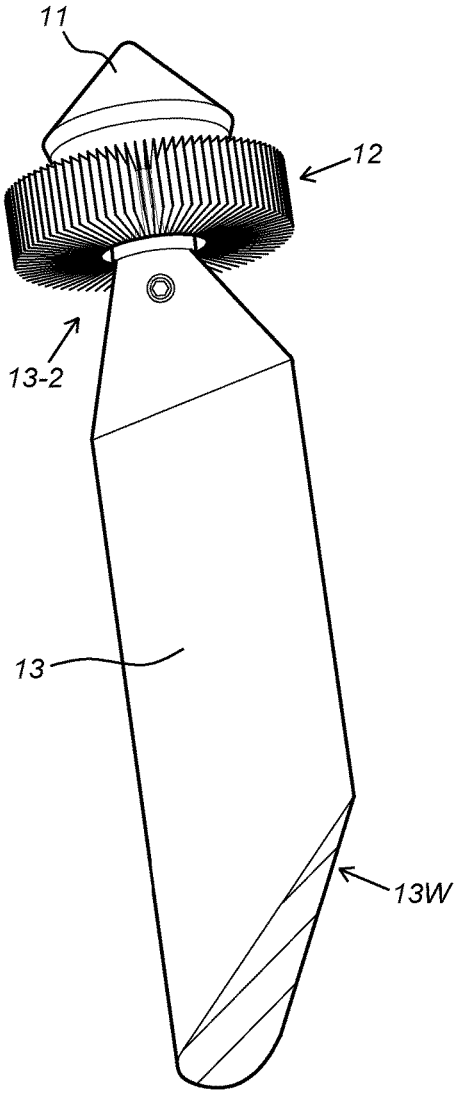
FIG. 5 shows a view in larger scale of the lever arm of the downhole tool of the invention.
Figure 6:
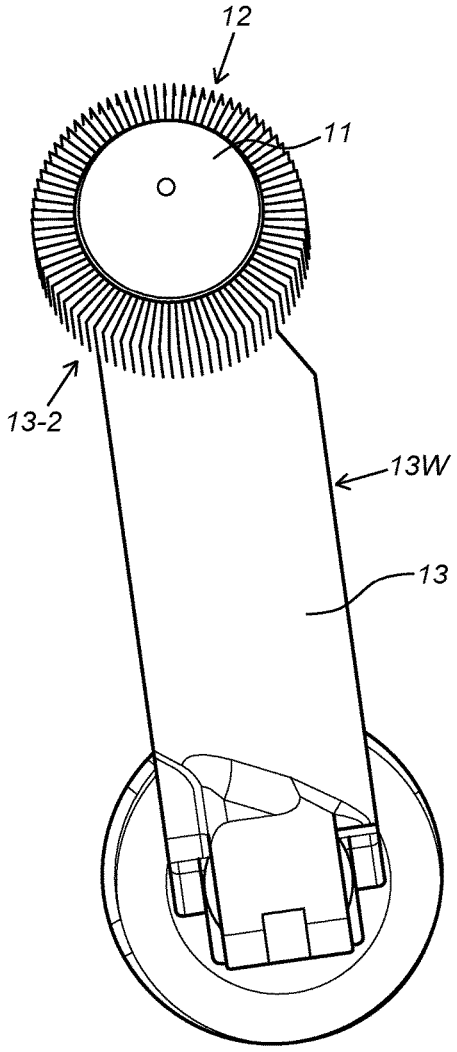
FIG. 6 shows the same part as FIG. 5, but viewed from a different angle.

FIG. 5 shows a view in a larger scale of the lever arm of the downhole tool of the invention. FIG. 6 shows the same part as FIG. 5, but viewed from a different angle. These figures serve to illustrate the shape of the wing 13W in clearer way. In addition, the connection of the bull nose 11 and the brush 12 to the second end 13-2 of the wing 13 is illustrated more clearly.

From FIGS. 5 and 6 it can be easily extracted that the invention is not limited to using only one brush 12. It is quite easy to implement more than one brush to the lever arm 13. Other variations of the invention are also possible and do not depart from the scope of the invention as claimed. An example is given hereinafter.

Figure 7:
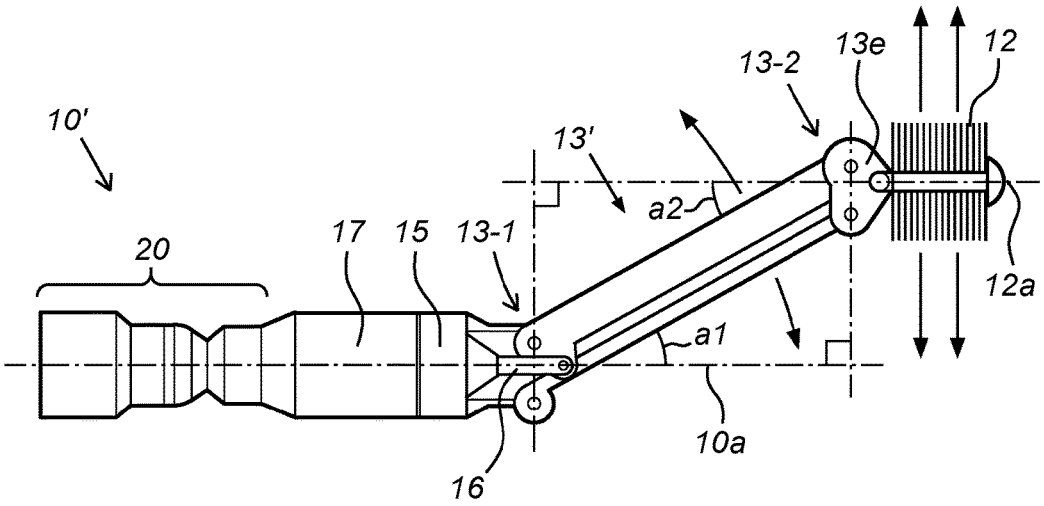
FIG. 7 shows an alternative embodiment of the downhole tool of the invention.
Figure 8:
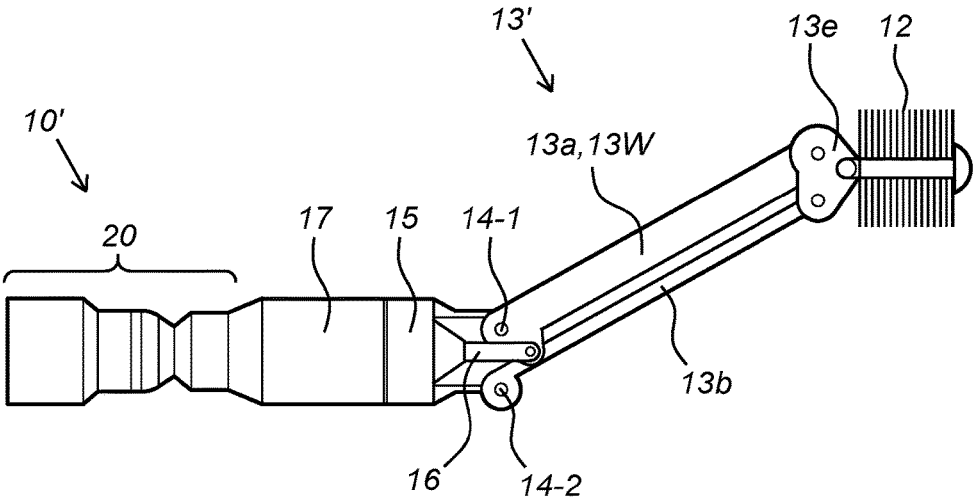
FIG. 8 shows some different aspects of the embodiment of FIG. 7.

FIG. 7 shows an alternative embodiment of the downhole tool of the invention. FIG. 8 shows some different aspects of the embodiment of FIG. 7. This embodiment will only be discussed in as far as it differs from the embodiment of FIGS. 1 to 6. The main purpose of this embodiment is to obtain a parallel shift of the brush 12 when the lever arm is moved outward as shown by the arrows in FIG. 7. Such embodiment is particularly advantageous when the downhole tool is run on over a bottom floor/wall of a tubing or casing 99, wherein the diameter of the tubing or casing 99 is significantly larger than the diameter of the downhole tool (having typically the diameter of a wireline tractor). The parallel shift of the brush 12 means that, when the lever arm assembly 13' moves outward, the virtual axial axis 12*a* of the brush 12 remains parallel to the virtual axial axis 10*a* of the downhole tool 10'. A consequence of that is that a better contact is obtained between the brush 12 and the floor/wall of a tubing or casing 99.

The parallel shift of the brush 12 is obtained by using a modified downhole tool 10'. This modified downhole tool 10' comprises a modified lever arm assembly 13' as illustrated in FIGS. 7 and 8. The modified lever arm assembly 13' comprises a first sub-arm 13*a*, which is similar to the one of FIGS. 1 to 6. In addition, the lever arm assembly 13' comprises a second sub-arm 13*b* that is configured to be orientated parallel to the first sub-arm 13*a*. The first sub-arm 13*a* is coupled to the mechanical support 15 via a first pivot point 14-1, and the second sub-arm 13*b* is coupled to the mechanical support 15 via a second pivot point 14-2. The two sub-arms 13*a*, 13*b* are both pivotably coupled to an end portion 13*e* to which the brush 12 is connected.

In this embodiment the first sub-arm 13*a* of the lever arm assembly 13' is also provided with a wing 13W (see FIG. 8) just as in the earlier discussed embodiments. As discussed earlier such wing 13W creates an additional outward directed force on the first sub-arm 13*a*. Alternatively, the second sub-arm 13*b* may also be provided with a wing (not shown) to enhance the outward directed force even more. Yet, in a further alternative embodiment only the second sub-arm 13*b* is provided with a wing.

Even though this embodiment provides for a parallel shift, in another embodiment the brush 12 rotates a little bit when moved outward, such that there is a difference angle between said virtual axial axes 10*a*, 12*a* albeit that this difference angle is then smaller than the angle a1 between the sub-arms 13*a*, 13*b* and the virtual axial axis 10*a* of the downhole tool 10'. Expressed differently the brush 12 in this embodiment is mounted to the respective lever arm assembly 13' such that the virtual axial axis 12*a* of the brush 12 makes an angle a2 with the respective sub-arms 13*a*, 13*b* to compensate at least partially for an angle a1 between the sub-arms 13*a*, 13*b* and the virtual axial axis 10*a* of the downhole tool 10' when the lever arm 13' is driven outwardly in operational use of the downhole tool 10'. Such effect could be obtained, when the heart-heart distance between the pivot points 14-1, 14-2 at the first end 13-1 of the lever arm is smaller than the heart-heart distance between the pivot points in the end portion 13*e* at the second end 13-2. Other implementations to reach the same effect are also possible. In the embodiment of FIGS. 7 and 8 the angle compensation is substantially 100%.

In the embodiment of FIGS. 7 and 8 the lever arm assembly 13' comprises two sub-arms 13*a*, 13*b* of which only one is actuated. In alternative embodiments both sub-arms are actuated. Yet in alternative embodiments a different number of sub-arms is used.

When a downhole tool 10, 10' such as shown in FIGS. 1 to 8 is used in operational use, such tool typically forms part of a tool string. Such knowledge is considered to be known to the person skilled in the art. Yet, in order to facilitate easy understanding of the invention, an example tool string is given here, considered from top to bottom:

- a cable head (with weak point);
- a swivel for taking out tension torque generated when running the wireline cable into the wellbore;
- a casing collar locator (CCL) for depth control;
- a wireline tractor for conveyance and for preventing the machinery to rotate when brushing (when no tractor is used in for instance vertical wells, another "anchoring" tool is needed for preventing rotation of the tool when brushing);
- a direct drive rotation (DDR), i.e. a rotational motor;
- a pump, which is a hydraulic pump device that generates a hydraulic pressure when the brush is rotated, and
- a brush 12 that delivers the outward force for effective brushing/honing.

The invention claimed is:

1. Downhole tool for use in a casing or tubing in a well, the downhole tool comprising:

- a central axial axis, the central axial axis offset from that of the casing or tubing when in an operational use of the downhole tool;
- a support arranged coaxial to the central axial axis of the downhole tool;
- a brush;
- at least one lever arm having a first end including a pivot point and pivotably mounted to the support and a second end opposite the first end, the brush being mounted at the second end;
- wherein the at least one lever arm is pivotally mounted at only the first end to the downhole tool; and
- a driver means for driving the at least one lever arm-outwardly to press the brush against a wall of the casing or tubing in the operational use of the downhole tool.

2. Downhole tool as claimed in claim 1, wherein the tool is configured for rotating the at least one lever arm around the casing or tubing in the operational use.

3. Downhole tool as claimed in claim 2, wherein the at least one lever arm is configured for being rotated with respect to the support for allowing said rotation of the at least one lever arm in the operational use.

4. Downhole tool as claimed in claim 2, wherein the support is configured for being rotated for allowing said rotation of the at least one lever arm in the operational use.

5. Downhole tool as claimed in claim 1, wherein the driver means for driving the lever arm comprises a wing formed by or coupled to the at least one lever arm for acting on well fluids in the well for creating an outwardly-directed force on the at least one lever arm when being rotated in the operational use of the downhole tool.

6. Downhole tool as claimed in claim 1, wherein the at least one lever arm comprises a sub-arm, the brush is mounted to the sub-arm such that a virtual axial axis of the brush makes an angle with the sub-arm to compensate at least partially for an angle between the sub-arms-and a virtual axial axis of the downhole tool when the at least one lever arm is driven outwardly in the operational use of the downhole tool.

7. Downhole tool as claimed in claim 6, wherein the sub arm forms part of a lever arm assembly that further comprises a further sub-arm that being pivotably coupled to mechanical support, the lever arm assembly further comprising an end portion to which said sub-arms are pivotably connected, the brush being mounted on the end portion.

8. Downhole tool as claimed in claim 7 wherein the lever arm assembly is configured for parallel displacement of the brush when the lever arm is driven outwardly in the operational use of the downhole tool.

9. Downhole tool as claimed in claim 1, wherein the driver means for driving the lever arm comprises an actuator for controlling an angular position of the at least one lever arm for pushing the at least one lever arm outwardly when being rotated in the operational use of the downhole tool.

10. Downhole tool as claimed in claim 1, wherein the brush comprises a cleaning brush and/or a honing brush.

11. Downhole tool as claimed in claim 1, wherein the at least one lever arm is pivotably mounted to the support with the first end.

12. Downhole tool as claimed in claim 1, the brush further comprising a central axial axis, the central axial axis of the brush when mounted at the second end of the lever arm being offset from the central axial axis of the downhole tool.

13. Method of cleaning or honing a casing or tubing in a well, the method comprising steps of:

- providing a downhole tool in the casing or tubing, the downhole tool including;
  - a central axial axis offset from that of the casing or tubing;
  - a support arranged coaxial to the central axis of the downhole tool; and
  - at least one lever arm having a pivot point at one end pivotally connected to the support and including a brush at another end;
- rotating the at least one lever arm of the downhole tool around the casing or tubing, and
- driving the brush on the at least one lever arm outwardly and pressing said brush against a wall of the casing or tubing while being rotated.

14. Method of claim 13, wherein in the step of providing the downhole tool, the downhole tool comprises a cleaning brush and/or a honing brush.

15. Downhole tool assembly comprising a wireline tractor and a downhole tool according to claim 1.

16. Wireline tractor comprising the downhole tool according to claim 1.

* * * * *